US008535084B2

(12) United States Patent
Koellmann

(10) Patent No.: US 8,535,084 B2
(45) Date of Patent: Sep. 17, 2013

(54) TERMINAL COMPONENT

(75) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 181 days.

(21) Appl. No.: 13/060,497

(22) PCT Filed: Aug. 4, 2009

(86) PCT No.: PCT/EP2009/005633

§ 371 (c)(1),
(2), (4) Date: May 18, 2011

(87) PCT Pub. No.: WO2010/022846

PCT Pub. Date: Mar. 4, 2010

(65) Prior Publication Data

US 2011/0212653 A1 Sep. 1, 2011

(30) Foreign Application Priority Data

Aug. 27, 2008 (DE) ..... 10 2008 039 864

(51) Int. Cl.
*H01R 4/24* (2006.01)

(52) U.S. Cl.
USPC ..... 439/441; 439/834

(58) Field of Classification Search
USPC ..... 439/441, 834
See application file for complete search history.

(56) References Cited

U.S. PATENT DOCUMENTS

| | | | | |
|---|---|---|---|---|
| 5,348,496 | A | 9/1994 | Ludwig | |
| 5,453,028 | A * | 9/1995 | Grambley et al. | 439/441 |
| 6,056,585 | A * | 5/2000 | Hatakeyama et al. | 439/441 |
| 6,074,242 | A * | 6/2000 | Stefaniu et al. | 439/441 |
| 6,336,824 | B1 * | 1/2002 | Sorig | 439/441 |
| 6,956,585 | B2 | 10/2005 | Muraki et al. | |
| 7,287,999 | B2 * | 10/2007 | Holterhoff et al. | 439/441 |
| 7,753,718 | B2 * | 7/2010 | Bethurum et al. | 439/441 |

FOREIGN PATENT DOCUMENTS

| | | |
|---|---|---|
| AT | 376 524 | 4/1984 |
| DE | 2 205 086 | 8/1973 |
| DE | 7911182 U1 | 8/1979 |
| DE | 29 22 447 A1 | 12/1979 |

(Continued)

*Primary Examiner* — Hien Vu
(74) *Attorney, Agent, or Firm* — Renner, Otto, Boisselle & Sklar, LLP

(57) ABSTRACT

Terminal components (1) having an insulating housing (2) and having at least one spring terminal (4) for terminating an electrical conductor (15) are described, wherein the spring terminal (4) has a busbar part (5) and a clamping spring (6) extending in the longitudinal extension direction (L) having a free clamping end (11) in the direction of the busbar part (5) and forming a clamping point for the electrical conductor (15) and pressing against the busbar part (5), and wherein at least one conductor insertion opening (3) leading to an associated clamping point is in the insulating housing (2) and one actuating channel (14) is arranged adjacent to each conductor insertion opening (3) for introducing an actuating tool (13) and opening the associated clamping spring (6) by means of the actuating tool (13). The actuating channel merges into an actuating section (12) of the clamping spring (6) adjacent to the clamping point for the electrical conductor (15) perpendicular to the longitudinal extension direction (L), so that the clamping point and the actuating section (12) lie adjacent to one another on the width of the clamping spring (6), and that the planes defined by the main axes of the conductor insertion opening (3) and of the actuating channel (14) and cutting the width of the clamping spring (6) perpendicular to the longitudinal extension direction of the clamping spring (6) in the area of the clamping point are approximately parallel to one another.

5 Claims, 3 Drawing Sheets

(56) References Cited

FOREIGN PATENT DOCUMENTS

| | | | |
|---|---|---|---|
| DE | 2724354 | C2 | 9/1982 |
| DE | 2737594 | C2 | 11/1983 |
| DE | 2838734 | C2 | 1/1985 |
| DE | 2826978 | C2 | 4/1988 |
| DE | 0 335 093 | A2 | 10/1989 |
| DE | 299 15 512 | U1 | 1/2001 |
| DE | 299 15 515 | U1 | 1/2001 |
| DE | 44 02 002 | B4 | 10/2005 |
| DE | 195 04 092 | B4 | 4/2006 |
| DE | 102006005260 | A1 | 8/2007 |
| DE | 102006018129 | A1 | 11/2007 |
| EP | 1 081 790 | A2 | 3/2001 |
| EP | 1 353 407 | A1 | 10/2003 |
| EP | 1 575 130 | A1 | 9/2005 |
| GB | 1 593 321 | | 1/1978 |
| JP | 3010475 | | 2/1995 |

* cited by examiner

TERMINAL COMPONENT

FIELD OF INVENTION

The invention relates to a terminal component having an insulating housing and having at least one spring terminal for terminating an electrical conductor, wherein the spring terminal has a busbar part and a clamping spring extending in the longitudinal extension direction having a free clamping end in the direction of the busbar part and forming a clamping point for the electrical conductor and pressing against the busbar part, and wherein at least one conductor insertion opening leading to an associated clamping point is in the insulating housing and one actuating channel is arranged adjacent to each conductor insertion opening for introducing an actuating tool and opening the associated clamping spring by means of the actuating tool.

BACKGROUND

Terminal components of this kind are sufficiently known in themselves, for example as rail-mounted terminals or as input/output modules of a fieldbus system which can be connected to field devices via the spring terminals, and are used particularly in automation engineering. With their clamping springs, the spring terminals provide a vibration-resistant contact with long-term stability for an electrical conductor. However, it is necessary to actuate the clamping spring against the restoring force of the spring in order to open the clamping point.

Actuating levers, which press on the clamping spring in the direction of the width of the clamping springs adjacent to the clamping point for the electrical conductor and which are integrated within the insulating housing, are disclosed in DE 299 15 515 U1, EP 0 335 093 B1, GB 1 593 321, AT 376 524 B and DE 28 26 978 C2, for example, for the purpose of actuating clamping springs. Here, the actuating direction of the actuating lever differs from the conductor insertion direction so that the spring terminals have a relatively large installation width.

Terminal components, in which actuating channels are provided at an angle to the conductor insertion opening in order to actuate a clamping spring, are disclosed for example in DE 27 24 354 C2 and DE 79 11 182 U1. The planes defined by the main axes of the conductor insertion openings and of the actuating channel and cutting the width of the clamping spring perpendicular to the longitudinal extension direction of the clamping spring in the area of the clamping point are at an angle to one another. The consequence of this is that the actuating channels associated with the conductor insertion openings take up a relatively large amount of space.

DE 195 04 092 B4 discloses a spring terminal for an electrical conductor with which a conductor insertion opening is arranged in the direction of deflection of a tension spring parallel to an actuating channel. While the conductor insertion opening merges with a clamping section at the free end of the tension spring, the actuating channel is aligned with an opposing actuating section of the tension spring connecting to the one spring arc in order to open the tension spring from there with a pressure pin.

A reverse actuation of this kind is also disclosed in DE 299 15 512 U1 for a clamping spring bent in a U-shape.

SUMMARY

Starting from this point, the object of the present invention is to create an improved terminal component with the smallest possible installation space which enables simple and reliable actuation of a spring terminal by means of an actuating tool inserted into an actuating channel.

The object is achieved by the terminal component of the kind mentioned in the introduction in that the actuating channel merges into an actuating section of the clamping spring adjacent to the clamping point for the electrical conductor perpendicular to the longitudinal extension direction, so that the clamping point and the actuating section lie adjacent to one another on the width of the clamping spring, and that the planes defined by the main axes of the conductor insertion openings and of the actuating channel and cutting the width of the clamping spring perpendicular to the longitudinal extension direction of the clamping spring in the area of the clamping point are approximately parallel to one another.

As a result of arranging the actuating channel and conductor insertion opening next to one another so that, when seen in cross section through the spring terminal, the actuating channel and conductor insertion opening are approximately in line, a minimum space is required for the actuating channel. At the same time, it is conceivable for the actuating channel and the conductor insertion opening to coincide and, in principle, for the same opening to be used. Conductor insertion opening and actuating channel can however also be at least partially separated from one another by a narrow wall.

The actuation of the clamping spring with an actuating tool via the actuating channel adjacent to the electrical conductor when viewed in the width of the clamping spring—and not as is usually the case above or below the clamping point—leads to the clamping spring being opened with the narrow side edge of a screwdriver and not as is conventionally the case with the wide wedge-shaped surface. This leads to the actuation being considerably more reliable and the risk of bending the actuating tool being reduced.

Such actuation by the narrow side edges of a screwdriver also enables the cross section of the actuating channel perpendicular to the longitudinal extension direction of the free end of the clamping spring in the direction of the width of the clamping spring to be narrower than that perpendicular to the width of the clamping spring. This further reduces the installation size.

It is particularly advantageous when at least one clamping spring is bent with a spring arc starting from a contact leg which extends substantially parallel to the main axis of the conductor insertion opening and rests against the insulating housing. A clamping leg then extends in the direction of the busbar which connects to the spring arc. In contrast to a cage tension spring, such an essentially simple clamping spring which is bent in a U-shape is fixed by means of the contact leg, or the clamping leg opposite, in the insulating housing and if necessary to or in the busbar. At the same time, the free end of the contact leg can, for example, be inserted into an opening in the busbar.

The clamping leg of the at least one clamping spring can be bent back in the direction of the contact leg in the merging area of the actuating channel, while the adjacent clamping section of the clamping spring for the electrical conductor in the direction of the width of the clamping spring extends away from the contact leg.

Viewed over the width of the clamping spring in the area of the clamping point, the clamping spring is therefore divided into two and has a clamping section which is optimized for terminating the electrical conductor and an actuating section which is optimized for actuation with an actuating tool via the actuating channel. The deflection of the spring can be limited by bending back the contact leg in the area of the actuating section. The bent-back section of the contact leg therefore forms an overload protection in that it hits the contact leg or the insulating housing in the actuated state of the clamping spring. In addition, bending back the clamping leg improves the guidance of an actuating tool so that the risk of the actuating tool jamming is reduced by the clamping spring.

In a corresponding manner, an overload stop, which is matched to the free clamping end of the clamping spring which forms the clamping point, is provided on the insulating housing or a busbar section in such a way that the free clamping end hits the overload stop when an attempt is made to excessively deflect the clamping spring with an electrical conductor.

The terminal component can be an active or passive component. Two or more spring terminals can therefore easily be connected to one another by the one common busbar in order thereby to electrically connect conductors which are terminated in the spring terminals.

However, it is also conceivable for electrically conductively connected electrical and/or electronic (active and/or passive) components to be arranged in the insulating housing with at least one spring terminal. A possible example of such a terminal component is an input/output module for terminating field devices, wherein connecting contacts for establishing a data bus and/or a power supply are arranged on the side surfaces of the insulating housing, when two or more terminal components are clipped onto a top-hat rail immediately adjacent to and adjoining one another. At the same time, it is advantageous when the insulating housing has latching hooks for clipping the terminal component onto a top-hat rail.

The invention is explained in more detail below with reference to exemplary embodiments using the attached drawings. In the drawings:

DETAILED DESCRIPTION

Figure 1:
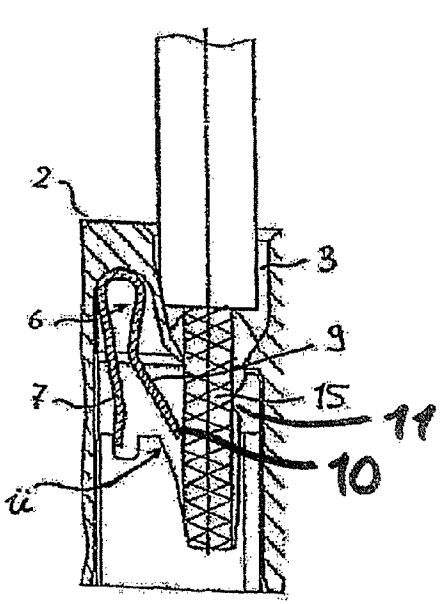
FIGS. 1*a-d*—show a cross-sectional view through a terminal component in partial section in the unactuated state, when actuated with a screwdriver, after inserting an electrical conductor and in the final clamped state.
Figure 1:
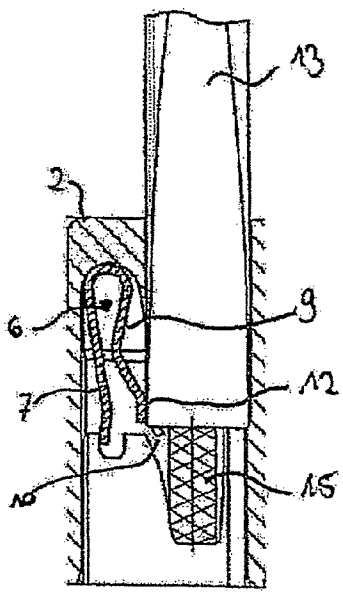
Figure 1:
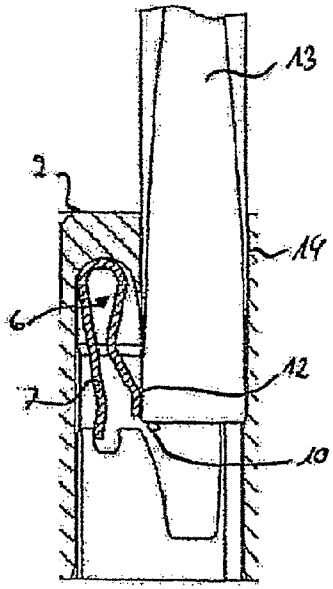
Figure 1:
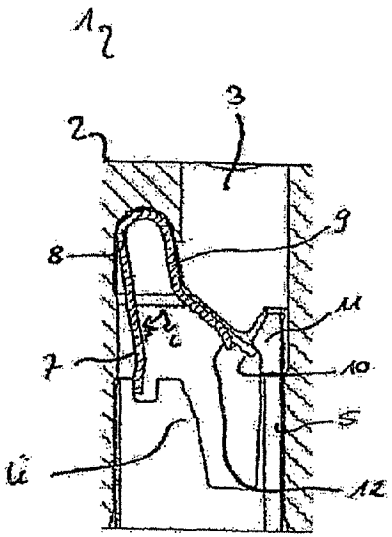

A partial section through a terminal component 1 in cross-section with an actuating sequence can be seen from FIGS. 1*a*) to *d*).

FIG. 1*a*) shows the partial section of the terminal component 1 in the unactuated state. It can be seen that a conductor insertion opening 3, which leads to a spring terminal 4, which is formed in a manner known per se from a busbar part 5 and a clamping spring 6 which is essentially bent in a U-shape, is made in an insulating housing 2. The clamping spring 6 has a contact section 7 which is fixed in the insulating housing 2 and/or the busbar part 5, a spring arc 8 which is connected thereto and a clamping leg 9 which is connected to the spring arc 8, the free end 10 of which clamping leg rests against a projection 11 of the busbar part 5 in the non-tensioned (relaxed) state and forms a clamping point for an electrical conductor in this area.

It is also clear that, over the width of the clamping spring 6, i.e. in the cross-sectional view in the direction of view perpendicular to the longitudinal extension direction L of the clamping leg 9 and perpendicular to the spring direction F of the clamping spring 6, the clamping leg 9 is divided into two in such a way that a clamping section of the free end 10 which forms at the clamping point and which rests against the busbar part extends in the direction of the busbar part 5, while an adjacent actuating section 12 over the width of the clamping spring 6 is bent back slightly in the direction of the contact leg 6. It can be seen that the deflection takes place over an angle of about 15 to 45 degrees from the longitudinal extension direction of the free end 10 which forms the clamping point. At the same time, the free end of the actuating section must not point towards the contact leg 7 in the relaxed state of the clamping spring 6, but is nevertheless bent back in the direction of the contact leg compared with the free end 10.

In a corresponding manner, an overload stop Ü, which is matched to the free clamping end 10 of the clamping spring 6 which forms the clamping point, is provided on the insulating housing 2 or a section of the busbar part 5 in such a way that the free clamping end 10 hits the overload stop Ü when an attempt is made to excessively deflect the clamping spring 6 with an electrical conductor. In this way, protection is also achieved against overload due to the electrical conductor, for example as a result of an inadmissibly bent conductor end or too large a conductor cross section.

The state of the terminal component 1 when actuated by a screwdriver 13 which is inserted in an actuating channel 14 which is arranged adjacent to the conductor insertion opening 3 and runs in the same line with reference to the cross section shown can be seen from FIG. 1*b*). The actuating channel 14 extends sufficiently far that the free end of the screwdriver 13 is able to reach the actuating section 12 and push the clamping leg 9 back in the direction of the contact leg 7 with the narrow side edge of the screwdriver 13. In doing so, the narrow side edge of the screwdriver 13 opposite the actuating section 12 rests against the insulating housing 2.

It can also be seen that, by bending back the clamping leg 9 in the area of the actuating section 12, the free end of the actuating section 12 rests approximately parallel against the narrow side edge of the screwdriver 13 and runs approximately parallel to the opposite wall of the insulating housing 2 in the area of the actuating channel 14 when the clamping spring 6 is fully extended. As a result, the risk of the screwdriver 13 jamming can be reduced by the clamping spring 6.

It is also clear that the free end 10 of the clamping leg 9 which forms the clamping point is guided past and behind the screwdriver 13 and, for example, protrudes slightly under the free end of the screwdriver 13. The screwdriver 13 as an actuating tool therefore works over the width of the clamping spring 16 in the area of the actuating section, while the adjacent clamping section with the clamping point remains free for an electrical conductor which is to be terminated.

The actuating state of the terminal component 1 can be seen in FIG. 1*c*) in which the clamping spring 6 is opened by the screwdriver 13 as in FIG. 1*b*) and an electrical conductor 15 with a free conductor end, which has been stripped of insulation at the end, is now inserted into the conductor insertion channel 3. By bending back the clamping leg 9 against the spring force in the direction of the contact leg 7, the free end 10 of the clamping leg 9 which forms the clamping point is sprung out of the conductor insertion area to such an extent that the electrical conductor 15 can be inserted into the insulating housing 2 and the spring terminal 4 without any problems.

The final clamping state can be seen from FIG. 1*d*) in which the screwdriver 13 is now withdrawn from the actuating channel 14 and thus leaves the actuating section 12 free. It is clear that, as a result, the clamping spring 6 can spring back with its clamping leg 9 in the direction of the busbar part so that the free end 10 which forms a clamping point rests against the stripped free end of the electrical conductor 15 and presses this against the busbar 5 and in particular against the projection 11 of the busbar 5. The projection 11 of the busbar 5 ensures a defined contact point with the smallest possible contact area so that the available spring force can be concentrated on this smallest possible contact area, which is known per se.

As a result of the actuating channel 14, which runs parallel to the conductor insertion direction when viewed in the transverse direction, and the provision of the actuating section in the width direction of the clamping spring 6, the terminal component 1 offers the possibility of a very space-saving design. In addition, in principle, the same opening can be used for the actuating channel 14 and the conductor insertion opening 3. However, it is also conceivable for a (thin) wall of insulating material, which is produced integrally with the insulating housing 2, to be provided between actuating channel 14 and conductor insertion opening 3.

The deflection of the clamping spring 6 can be limited by angling the clamping leg 9 to the side in the area of the actuating section. This can be seen more easily from FIG. 2, which shows a cross-sectional view of a terminal component 1 in partial section with non-tensioned clamping leg 9 in the rest position and clamping leg 7 bent back in the direction of the contact leg 7 in the actuating position. From the actuating position shown in the left-hand half, it is clear that the actuating section 12, which is bent in the direction of the contact leg 7, rests with its free end of the clamping leg 9 against the contact leg 7 when the screwdriver 13 is inserted in the actuating channel 14. This prevents further deflection and overloading of the clamping spring 6.

It can also be seen that the contact leg 7 of the clamping spring 6 protrudes into an opening of the busbar part 5 with its free end in order to fix the clamping spring 6 to the busbar part 5. It can also be seen that the busbar part 5 itself is bent approximately in a U-shape in order to provide a stop surface at the bottom thereof for the electrical conductor 15, and to provide a clamping point with its upwardly bent free end.

Figure 2:
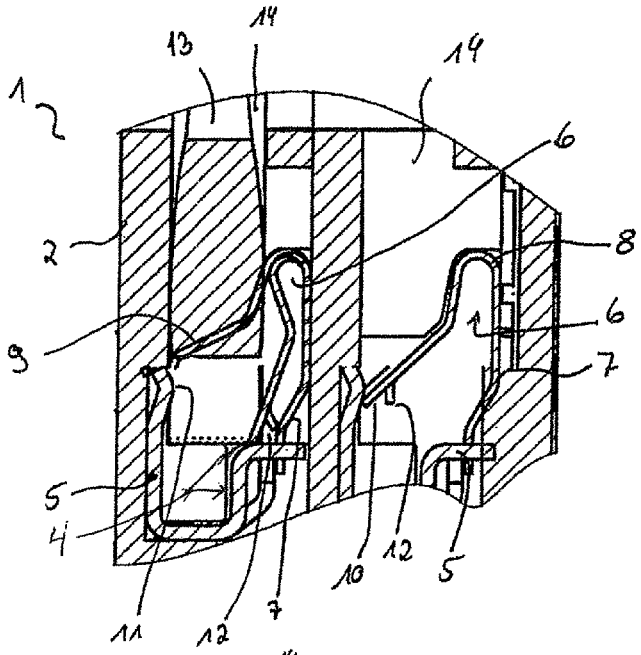
FIG. 2—shows a cross-sectional view of a terminal component in partial section with a clamping leg bent back in the direction of the contact leg in the area of the actuating section.
Figure 3:
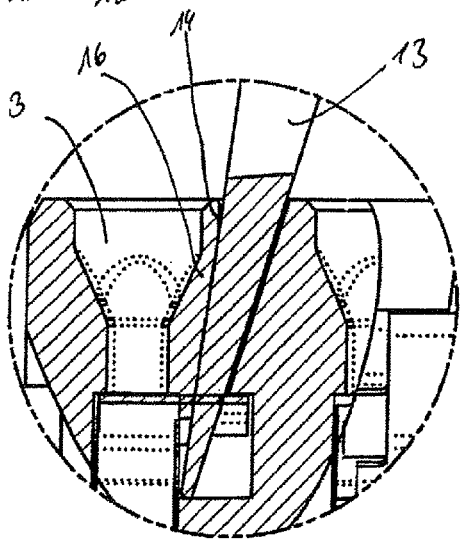
FIG. 3—shows a longitudinal section through the terminal component of FIG. 2 in partial section.

A longitudinal section through the terminal component 1 of FIG. 2 can be seen in partial section in FIG. 3. Here, it is clear that in the embodiment shown the conductor insertion opening 3 is spatially separated from the actuating channel 14 by an intermediate wall 16 of insulating material of the insulating housing 2. It can also be seen that in cross section, i.e. viewed in the direction of the width of the clamping spring 6, the actuating channel runs in line with the conductor insertion opening 3, while the main axis of the actuating channel 14 in the longitudinal section (FIG. 3) is tilted at a slight angle (5 to 25 degrees) to the main axis of the conductor insertion opening 3. It is also clear that the actuating channel tapers conically from the top opening down to the spring terminal 4 in the longitudinal section and is therefore appropriately matched to the conically tapering contour of conventional screwdrivers 13.

Figure 4:
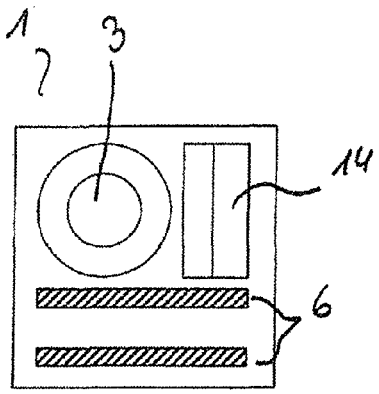
FIG. 4—shows a plan view of the terminal components of FIGS. 1 to 3 in the area of a clamping point.
Figure 5:
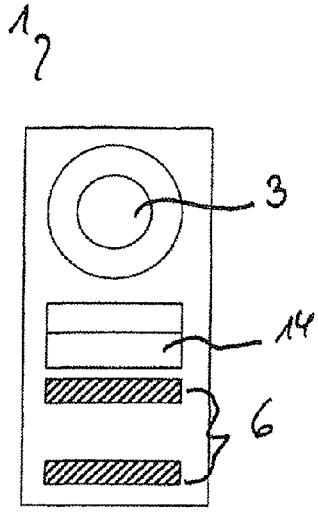
Fig. 5 Prior Art
FIG. 5—shows a plan view of a conventional terminal component in the area of a clamping point.

FIG. 4 shows a plan view of the terminal components 1 of FIGS. 1 to 3 in the area of a clamping point. It is clear that an approximately square space distribution, which is balanced in length and width, results from the actuation of the spring terminal with a screwdriver inserted edgewise and the resulting possible arrangement of the actuating channel 14 in the width direction of the clamping spring 6 adjacent to the conductor insertion opening 3. On the other hand, a space requirement which is unequal in width and length results in the case of the conventional terminal components 1 shown in FIG. 5. As a result of the balanced distribution of clamping spring 6, actuating channel 14 and conductor insertion opening 3, the terminal component 1 according to the invention enables spring terminals to be placed in a uniform grid. As a result of the greater width of the clamping spring 6 compared with the conventional version shown in FIG. 5, it is possible to reduce the thickness of the spring steel sheet, as a result of which the radius of the spring arc can also be reduced without having an adverse effect on the spring force. This leads to a reduction in the installation size.

The terminal component 1 can be a rail-mounted terminal, for example, with which two or more clamping points are connected to one another by means of the busbars 5. Rail-mounted terminals of this kind are adequately known per se. They can also be fitted with electrical and/or electronic components such as relays, fuses etc. in order thus to form so-called function terminals such as isolating and measuring terminals, fuse terminals, sensor and actuator terminals, diode terminals, LED terminals, etc. However, it is also conceivable for terminal components to be modules for automation engineering such as, for example, fieldbus couplers and input/output modules connected thereto, which are connected to fieldbus devices by means of the spring terminals. At the same time, it is advantageous when two connecting contacts for establishing a data bus and/or a power supply protrude from the side walls of the insulating housing when terminal components are placed adjacent and adjoining one another on a top-hat rail (cf. DE 44 02 002 B4).

The invention claimed is:

1. An electrical terminal assembly, comprising:

at least one busbar part;

at least one clamping spring extending in a longitudinal extension direction (L), said at least one clamping spring having a free clamping end extending in a direction of the busbar part and configured to press on an inserted electrical conductor of a cable against the busbar part in a clamping area of an insulated housing;

the insulating housing having at least one conductor insertion opening leading to the clamping area in the insulating housing; and at least one actuating channel arranged adjacent to the at least one conductor insertion opening, said at least one actuating channel configured for introducing an actuating tool for pressing down the at least one clamping spring by means of the actuating tool, wherein the at least one actuating channel merges in a merging area into an actuating section of the at least one clamping spring extending outwardly and adjacent to the clamping area for the electrical conductor and perpendicular to the longitudinal extension direction (L), so that the clamping area and the actuating section lie adjacent to one another on the width of the at least one clamping spring, and so that planes defined by the main axes of the conductor insertion opening and of the actuating channel and the at least one clamping spring in the clamping area when intersecting along the width of the clamping spring perpendicular to the longitudinal extension direction (L) are approximately parallel to one another, wherein the insulating housing has an intermediate wall spatially separating the conductor opening from the actuating channel, and wherein a cross section of the actuating channel perpendicular to the longitudinal extension direction (L) is narrower in a direction of the width of the clamping spring than a cross-section perpendicular to the width of the clamping spring.

2. The electrical terminal assembly component according to claim 1, wherein the at least one clamping spring is bent with a spring arc starting from a contact leg which extends substantially parallel to the main axis of the conductor insertion opening and rests against the insulating housing, and having a clamping leg connected to the spring arc that extends in a direction of the busbar part.

3. The electrical terminal assembly component according to claim 2, wherein the contact leg of the at least one clamping spring is fixed in the busbar part.

4. The electrical terminal assembly component according to claim 2, wherein the clamping leg is bent back in a direction of the contact leg in the merging area of the actuating channel, while an adjacent clamping point section of the at least one clamping spring for the electrical conductor in a direction of a width of the clamping spring extends away from the contact leg.

5. The electrical terminal assembly component (1) according to claim 1, further comprising:

an overload stop (Ü), which is matched to the free clamping end of the at least one clamping spring in the clamping area configured on the insulating housing or the busbar part in such a way that an excessive deflection of the clamping spring by an electrical conductor is prevented by the free clamping end hitting the overload stop (Ü).

* * * * *

UNITED STATES PATENT AND TRADEMARK OFFICE

CERTIFICATE OF CORRECTION

PATENT NO. : 8,535,084 B2
APPLICATION NO. : 13/060497
DATED : September 17, 2013
INVENTOR(S) : Hans-Josef Koellmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 262 days.

Signed and Sealed this
Fifteenth Day of September, 2015

Michelle K. Lee

Michelle K. Lee
*Director of the United States Patent and Trademark Office*